United States Patent [19]

Wittmann

[11] Patent Number: 4,475,743

[45] Date of Patent: Oct. 9, 1984

[54] HEEL HOLDER

[75] Inventor: Heinz Wittmann, Vienna, Austria

[73] Assignee: TMC Corporation, Baar, Switzerland

[21] Appl. No.: 409,480

[22] Filed: Aug. 19, 1982

[30] Foreign Application Priority Data

Aug. 21, 1981 [AT] Austria ..... 3661/81

[51] Int. Cl.[3] ..... A63C 9/08

[52] U.S. Cl. ..... 280/632; 280/633

[58] Field of Search ..... 280/626, 631, 632, 633, 280/623

[56] References Cited

U.S. PATENT DOCUMENTS

| | | | |
|---|---|---|---|
| 3,529,845 | 9/1970 | Kanno | 280/626 |
| 3,933,363 | 1/1976 | Schweizer et al. | 280/632 |
| 3,989,274 | 11/1976 | Weigl et al. | 280/634 |
| 4,022,493 | 5/1977 | Weigl et al. | 280/633 |
| 4,111,453 | 9/1978 | Krob | 280/626 |
| 4,214,773 | 7/1980 | Wittmann | 280/631 |
| 4,307,895 | 12/1981 | Storandt et al. | 280/632 |

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

A heel holder for a ski binding includes a guide rail, a base plate movably supported on the guide rail, and an abutment which can be releasably secured to the guide rail. A thrust spring urges the base plate forwardly relative to the abutment. A sole holder and spring housing are pivotally supported on the base plate, the sole holder pivotally supporting a pawl and the spring housing supporting a release spring which biases the pawl against a control surface provided on the base plate. An upwardly projecting control part provided on the abutment, when the thrust spring moves the base plate forwardly with the sole holder in a closed position, cooperates with a cam provided on the spring housing and pivots the spring housing, thereby interrupting the force exerted by the release spring on the pawl so that a spring cooperable with the sole holder can move it into an open position.

9 Claims, 5 Drawing Figures

HEEL HOLDER

FIELD OF THE INVENTION

This invention relates to a heel holder for a safety ski binding and, more particularly, to a heel holder which includes a base plate which is supported for movement against the force of at least one thrust spring on a ski-fixed guide rail and carries a bearing block on which a sole holder is pivotally supported, which sole holder is held in a downhill skiing position by means of a pawl supported thereon which has one side engaging a control surface and on the other side is biased by a spring arranged in a spring housing which is pivotally supported.

BACKGROUND OF THE INVENTION

A heel holder of the above-mentioned type is described, for example, in Austrian Pat. No. 327 068 (corresponds to U.S. Pat. No. 3,933,363), and is also known in the form of products which are commercially available. These heel bindings have been successful in practice and are comfortable for the skier to handle, but have the disadvantages that, during a release of only the front jaw, for example during a twisting fall, the heel holder remains closed so that the skier, in order to again step into the binding, must open the sole holder manually by means of a release lever.

Therefore, the invention has as one purpose to further develop a heel holder of the above-mentioned type so that it is automatically ready for being stepped into after a release of only the front jaw.

A heel holder which automatically becomes ready for being stepped into after a release of only the front jaw is described in U.S. Pat. No. 4,111,453. Since the housing and the bearing block each have to have two arcuate slots to enable the pivoting movement relative to the pin and for the pin, respectively, a disadvantage of the known solution is that there are openings through which snow, ice or the like can enter into the heel holder.

The invention has as a further purpose to overcome this disadvantage and to develop a heel holder of the above-mentioned type so that the whole control mechanism can be arranged within the housing.

SUMMARY OF THE INVENTION

This purpose is attained inventively by providing a heel holder of the above-mentioned type in which at least one control part is secured or pivotally supported on a ski-fixed abutment of the thrust spring, extends through a recess in the base plate and, during relaxation of the thrust spring when no heel release has occurred, engages the spring housing and moves it so as to interrupt the biasing force exerted by the release spring on the pawl.

The set purpose is satisfactorily achieved by these inventive measures. In the case of only a front-jaw release during the relaxation of the thrust spring which causes movement of the heel holder toward the tip of the ski, the control part engages the spring housing and moves it so as to interrupt the biasing force exerted by the release spring on the pawl, and the pawl then comes free from the control surface and permits the sole holder to be pivoted by a spring to its open position, so that the heel holder is again ready for a stepping in.

Also, it is inventively advantageous if the control part on the ski-fixed abutment can be swung upwardly away from the plane of the ski within a given range and is urged toward a rest position by a return spring which is preferably a torsion spring. In this manner, friction which occurs between the spring housing and the control part is reduced.

A further characteristic of the invention consists in each control part having a control nose which, when the heel holder is closed, is disposed in the relaxed and also in the initially tensioned position of the thrust spring in respective locking recesses of the spring housing, which locking recesses are arranged one behind the other in the longitudinal direction of the ski, and between which is provided a cam which projects toward the upper side of the ski. One locking recess assures an unhindered closing of the heel holder, even when the ski shoe is not inserted, and the second recess receives the control part when the ski shoe has been inserted into the binding. The cam which is arranged between the locking recesses, during a release of only the front jaw, is engaged by the control nose of the control part, which causes the spring housing to be lifted and thus interrupts the release spring force exerted on the pawl.

A particularly advantageous development of the invention exists when the abutment is formed by a forked member which has at one end a web for supporting the thrust spring and has at the other end a notch which is provided for effecting engagement or disengagement of the abutment with the guide rail, and when the control part is secured or pivotally supported on a leg of the fork. In this manner, an arrangement of the control part on many conventional heel holders which are available on the market is possible with minimal structural expense.

BRIEF DESCRIPTION OF THE DRAWINGS

Further characteristics, advantages and details of the invention will now be described in greater detail in connection with the drawing, which illustrates two exemplary embodiments.

In the drawing.

DETAILED DESCRIPTION

Figure 1:
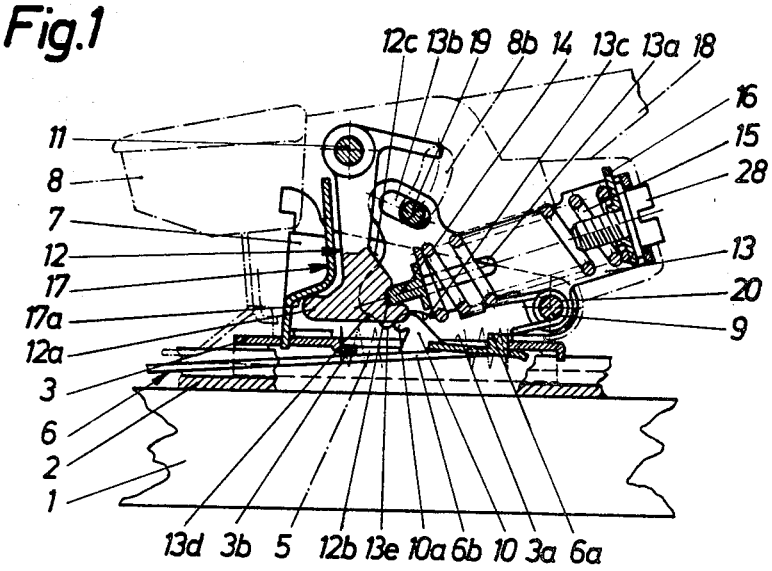
FIG. 1 is a sectional side view of a first exemplary embodiment of an inventive heel holder in a closed position without a ski shoe inserted.

As can be seen from FIG. 1, a guide rail 2 is secured in a conventional manner, for example by means of not illustrated screws, on the upper side of a ski 1. A base plate 3 of the heel holder is supported for movement longitudinally of the ski 1 on the guide rail 2 and can be positioned at a desired location in a conventional manner for adjusting the binding to different length ski shoes. A thrust spring 5 is arranged in a recess **3*a* of the base plate 3, one end of the thrust spring 5 being supported on a support part 3*b* of the base plate and the other end being supported on a web or crossbar of a forked member which is the ski-fixed abutment 6, which member grips over the edges of the recess 3a by means of two indicating pins 6a. Thus, the heel holder is supported for movement, under the urging of the thrust spring 5, on the guide rail 2. The indicating pins 6a serve, in connection with a scale provided on the base plate 3 and when a ski shoe is inserted in the binding, to indicate the pressure the heel holder exerts on the boot and thus against a conventional front jaw (not illustrated). The abutment 6 has two legs 6b which are arranged laterally of the thrust spring 5 and extend approximately parallel to the longitudinal axis of the ski 1, which legs converge near the front end of the recess 3a of the base plate 3 to a locking tongue which cooperates in a conventional and therefore not illustrated manner with a mechanism for locking it against movement with respect to the guide rail 2. At least one of the two legs 6b of the abutment 6 carries a control part 10, which extends upwardly from below through the recess 3a of the base plate 3**, the design and operation of which will yet be discussed in greater detail.

In other words, the base plate 3 is movably supported on the guide rail 2 in a conventional manner and is urged forwardly relative to the abutment 6 by the thrust spring 5. The abutment 6 can be releasably secured in a conventional manner at predetermined locations along the guide rail 2 which correspond to different length ski shoes. When a ski shoe is inserted, the heel holder and the base plate 3 will be moved rearwardly somewhat relative to the abutment 6 against the force of the spring 5. The spring 5 will thus urge the heel holder and its base plate 3 forwardly, thereby urging the sole of the ski shoe forwardly against the front jaw of the binding. The magnitude of this force will depend on the extent to which the spring 5 was compressed when the ski show was inserted, is proportioned to the position of the pins 6c in the recess 3a, and can thus be read from the point on the scale on the base plate 3 which the pins 6a are aligned with. The structure described above is similar to that disclosed in U.S. Pat. Nos. 3,989,274 and 4,022,493, the disclosures of which are incorporated herein by reference.

A bearing block 7 is secured on the base plate 3 and a sole holder 8 is supported pivotally on the bearing block 7 for movement about an axle 9. The sole holder 8 carries a further axle 11 which extends parallel to the first-mentioned axle and pivotally supports a pawl 12 which, in the downhill skiing position of the heel holder, grips by means of a locking nose 12a thereon under a cam 17a of a control surface 17 which is provided on the bearing block 7. Furthermore, a spring housing or support member 13 which, viewed in the top view, is approximately U-shaped is pivotally supported on the axle 9 of the sole holder 8 and has longitudinal slots 13a which movably support and form guideways for a locking part 14. The locking part 14 is biased by one end of a release spring 15, the other end of which is supported on a spring abutment 16 which can be adjusted axially of the release spring 15 by means of a screw 28 which is rotatably supported in the spring housing 13.

The pawl 12 has a notch 12b for the locking part 14, into engagement with which notch the locking part is urged by the release spring 15. A depression 12c is provided on the pawl 12 just above the notch 12b, the locking part 14 moving into the depression 12c upon operation of a release lever 18.

The release lever 18 has two legs which are disposed on opposite lateral sides of the sole holder 8, and the lever 18 is supported pivotally on the axle 11 of the sole holder 8, on which axle 11 is also pivotally supported the pawl 12. A pin 19 secured on the release lever 18 extends parallel to the axis 11, and extends slidingly through slots 8b in the sole holder 8 and through slots 13b in the sidewalls of the spring housing 13. The two slots 8b which are provided on the sole holder 8 are arcuate and arranged concentrically to the swivel axle 11, and the two slots 13b in the spring housing 13 are arranged approximately at a right angle with respect to the slots 8b in the sole holder 8. During swinging up of the release lever 18 to effect a voluntary release, the pin 19 slides upwardly in the slotted holes 8b of the sole holder 8 and simultaneously slides in the slotted holes 13b of the spring housing 13 in a direction toward the tip of the ski, causing the housing 13 to pivot upwardly about the axle 9. Thus, the locking part 14 is moved upwardly by the housing 13 out of engagement with the notch 12b in the pawl 12. This permits the pawl 12 to pivot rearwardly and its locking nose 12a to move from under the cam 17a of the control surface 17 of the bearing block 7. The sole holer 8 is then swiveled by a torsion spring 20 arranged on the axle 9 to an open position.

Figure 2:
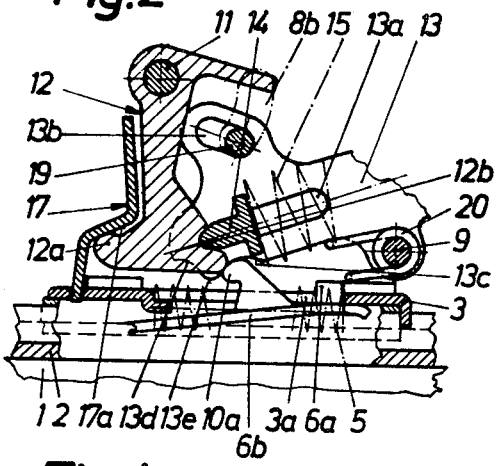
FIG. 2 is a sectional side view of the locking mechanism of the heel holder of FIG. 1 in an enlarged scale.
Figure 3:
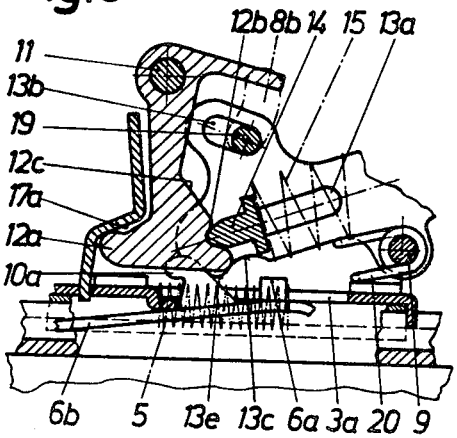
FIG. 3 is a view of the locking mechanism similar to FIG. 2, but in an operational position effected by insertion of a ski shoe.

The control part 10, which is secured on a leg 6b of the abutment 6, has a control nose 10a which, in the closed position of the sole holder 8 and when a ski shoe is not inserted in the binding, is disposed in a locking recess 13c provided in the associated sidewall of the spring housing 13. The locking recess 13c is constructed on the lower edge of such sidewall, as shown in FIG. 2.

When a ski shoe steps into the heel holder, it moves the heel holer rearwardly against the force of the thrust spring 5 on the ski-fixed guide rail 2 toward the tail of the ski. After the swinging down of the sole holder 8 has taken place, the control part 10, which has remained stationary with respect to the ski 1, will have its control nose 10a disposed in a further locking recess 13d which is also constructed on the lower edge of the sidewall of the spring housing 13.

Figure 4:
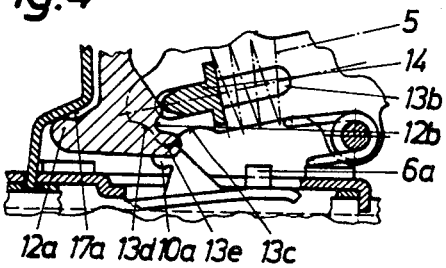
FIG. 4 is a view similar to FIG. 2 which illustrates an operational position of the locking mechanism reached during a release of a not illustrated front jaw.

If, during a fall of the skier, for example during a twisting fall, a release of the not illustrated front jaw occurs, then the heel holder is moved along the guide rail 3 by the thrust spring 5 toward the front jaw. The control nose 10a of the control part 10 thus moves into engagement with a cam 13e on the spring housing 13, which cam is located between the two locking recesses 13c and 13d, and presses the spring housing 13 upwardly to the degree needed to move the locking part 14 supported in the spring housing 13 upwardly and out of engagement with the notch 12b, as shown in FIG. 4. The pawl 12 is no longer biased by the release spring 15. The opening operation of the sole holder 8 then occurs under the urging of the torsion spring 20 in the manner already described with respect to a voluntary opening. The heel holder is then ready for stepping in, and stepping in subsequently occurs in a conventional manner, either by closing the release lever 18 with a subsequent swinging down of the sole holder 8 by the ski shoe, or by first swinging down the sole holder 8 and then the release lever 18.

Figure 5:
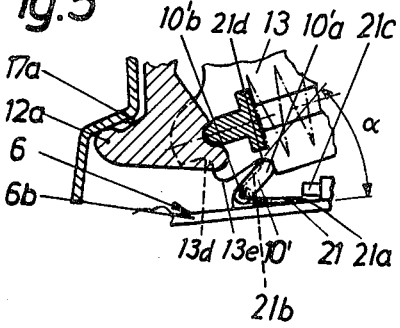
FIG. 5 illustrates a second exemplary embodiment in a view similar to FIG. 2.

FIG. 5 shows a modified embodiment of the control part 10', which is pivotally supported on the leg 6b of the abutment 6 and is yieldably held in the position illustrated in FIG. 5 by a torsion spring 21. The spring 21 is a leg spring. One of the legs 21a lies on the surface of the abutment 6, and the other leg 21b acts upon the control part 10'. There are further stops 21c, 21d arranged on the legs 21*a*, 21*b* of the spring 21 to hold each of the legs 21*a*, 21*b* on the abutment 6 and on the control part 10' respectively. The spring 21 is according to FIG. 5 in its relaxed position, whereby the angle $\alpha$ between the legs 21*a*, 21*b* defines the relaxed position of the spring 21. That means that each pivotal movement of the control part 10' out of this position increases the tension of the spring 21. In the position which is shown in FIG. 5, and which is similar to FIG. 2 of the first embodiment, the rearward recess 13*c* is in engagement with the control part 10'. This construction has the advantage that the control part 10' can swing through a range defined by the spring 21, whereby the friction which would otherwise occur between the spring housing 13 and the control part 10' is reduced. This advantage compensates the more expensive costs of this embodiment.

When a ski shoe steps into the heel holder, it moves the heel holder rearwardly against the force of the thrust spring 5 on the ski-fixed guide rail 2 toward the tail of the ski. After the swinging down of the sole holder 8 has taken place, the control part 10', which has remained stationary with respect to the ski 1, will have its control nose 10'*a* disposed in the forward locking recess 13*d* of the spring housing 13. This is the skiing position of the heel holder with an inserted ski shoe in the binding.

If, during a fall of the skier, for example during a twisting fall, a release of the not illustrated front jaw occurs, then the heel holder is moved along the guide rail 3 by the thrust spring 5 toward the front jaw. The control nose 10'*a* of the control part 10' thus moves into engagement with the cam 13*e* on the spring housing 13, which cam is located between the two locking recesses 13*c* and 13*d*, and presses the spring housing 13 upwardly to the degree needed to move the locking part 14 supported in the spring housing 13 upwardly and out of engagement with the notch 12*b*. The needed degree is ensured by the difference between the projection of the top of the control nose 10'*a* of the control part 10' on a plane which is vertically arranged on the axle 10'*b* of the control part 10' and the above mentioned top of the control part 10' lies in this plane (its angle is 90° relative to the surface of the abutment 6). Because of this movement of the housing 13 the sole holder 8 swings upwardly in the manner already described with respect to a involuntary or unvoluntary opening. The heel holder is then ready for a stepping in, as described in connection with the foregoing embodiment. After the recess 13*d* is disengaged from the control part 10' the spring 21 swings in clockwise direction to its standard position which is shown in FIG. 5.

During the step in movement with the ski shoe the cam 13*e* of the housing 13 presses on the control nose 10'*a* of the control part 10' so that it swings clockwise against the force of the spring 21 in the direction toward the abutment 6. The two legs 21*a*, 21*b* of the spring 21 move toward each together, and the angle $\alpha$ decreases. As soon as the heel holder is moved against the force of the thrust spring 5 in a manner rearwardly so that the cam 13*e* comes out of engagement with the control part 10', the spring 21 urges this part into engagement with the recess 13*d* of the housing 13. The surface of the recess 13*d* according to FIG. 5 is different from that according to the FIGS. 1 to 4 because of the above mention assurance of the needed degree to open the heel holder.

The invention is not limited to the illustrated exemplary embodiments. Variations and modifications, including the rearrangement of parts, are conceivable without leaving the scope of protection. Thus, it is possible to inexpensively provide any of various heel bindings, the release mechanism of which includes a member which is biased against a control surface and can be pressed away therefrom, with the inventive control part. Also, it is possible to utilize two thrust springs in place of just one thrust spring.

The embodiments of the invention in which an exclusive property or privilege is claimed are defined as follows:

1. In a heel holder for a safety ski binding, including a guide rail adapted to be secured to a ski and a base plate which is supported for movement against the force of a thrust spring on said guide rail and carries a bearing block on which a sole holder is pivotally supported, said sole holder being releasably held in a downhill skiing position by releasable locking means which includes a pawl which is movably supported on said sole holder, said pawl having one side which engages a control surface provided on said bearing block and being engaged on its other side by means which includes a release spring supported on a pivotally supported spring housing, said release spring biasing said pawl toward said control surface, the improvement comprising a control part which is supported on an abutment which is supported on said guide rail and supports one end of said thrust spring, and said control part extending upwardly through a recess provided in said base plate and, during movement of said base plate relative to said guide rail by said thrust spring when said locking means is releasably holding said sole holder in said downhill skiing position, engaging said spring housing and moving it so as to substantially interrupt the biasing force exerted by said release spring on said pawl.

2. The heel holder according to claim 1, wherein said control part is supported on said abutment for pivotal movement within a limited range and is urged toward a rest position by a return spring.

3. The heel holder according to claim 1 or claim 2, wherein said control part has a control nose which, when said heel holder is in said downhill skiing position, is disposed in a relaxed and in an initially tensioned position of said thrust spring in respective locking recesses provided in said spring housing, said locking recesses being arranged at spaced locations in the longitudinal direction of the ski, and wherein between said locking recesses there is provided a cam which projects toward an upper side of the ski.

4. The heel holder according to claim 1 or claim 2, wherein said abutment includes a forked member which has at one end a web which supports said one end of said thrust spring and has at its other end means adapted for selective engagement with said guide rail for permitting said abutment to be relesably held against movement relative to said guide rail in selected positions therealong, and wherein said control part is supported on a leg of said forked member.

5. A safety ski binding for releasable holding a ski boot on a ski, comprising: a guide rail adapted to be secured to the ski; a base supported on said guide rail for movement longitudinally of the ski; first resilient means yieldably urging said base in one direction relative to said guide rail; a binding part mounted on said base, said binding part including a sole holder which is adapted to engage a sole of the ski boot and is supported for generally vertical movement relative to said base, second resilient means yieldably urging said sole holder upwardly, and locking means for releasably holding said sole holder against upward movement relative to said base, said locking means including a cam provided on said base, a locking part supported on said sole holder for approximately horizontal movement toward and away from said cam, a support member supported on said base for generally vertical movement, a locking member supported on said support member for generally horizontal movement toward and away from said locking part, and third resilient means cooperable with said locking member for yieldably urging it toward said locking part; a control part; and means supporting said control part on said guide rail, said control part being engageable with said support member; wherein during movement of said base by said first resilient means in said one direction relative to said guide rail when said locking means is releasably holding said sole holder against upward movement, said control part engages said support member and causes said support member and said locking member to move upwardly relative to said locking part from an initial position to a position in which a force exerted on said locking part by said locking member and said third resilient means is substantially less than in said initial position.

6. The ski binding according to claim 5, wherein said means supporting said control part includes an abutment supported on said guide rail for movement therealong in directions longitudinally of the ski and adapted to be releasably held in a selected position, said control part being supported on said abutment, and wherein said first resilient means includes a helical spring having one end supported on said abutment and its other end supported on said base.

7. The ski binding according to claim 6, wherein said control part is pivotally supported on said abutment for movement between first and second positions, and including fourth resilient means cooperable with said control part for yieldably urging it toward said first position.

8. The ski binding according to claim 7, wherein said support member has a downwardly projecting cam thereon which is engageable with said control part.

9. The ski binding according to claim 6, wherein said abutment includes a web and two spaced, parallel legs, said helical spring being disposed between said legs of said abutment and said one end thereof being supported on said web of said abutment, said control part being provided on one of said legs of said abutment and projecting upwardly therefrom.

* * * * *